US005743783A

United States Patent [19]

Weber-Unger

[11] Patent Number: 5,743,783

[45] Date of Patent: Apr. 28, 1998

[54] PANTY GIRDLE

[75] Inventor: Georg Weber-Unger, Kufstein, Austria

[73] Assignee: Anita International Helbig GmbH & Co. KG, Brannenburg, Germany

[21] Appl. No.: 732,145

[22] Filed: Oct. 16, 1996

[30] Foreign Application Priority Data

Oct. 19, 1995 [DE] Germany ..... 195 40 242.1

[51] Int. Cl.[6] ..... A41C 1/08

[52] U.S. Cl. ..... 450/155; 2/44; 2/237; 450/132; 602/19

[58] Field of Search ..... 450/155, 117–136; 2/44, 455, 456, 464, 467, 45, 400, 406, 408, 409, 237, 227; 602/19

[56] References Cited

U.S. PATENT DOCUMENTS

| | | | |
|---|---|---|---|
| D. 87,725 | 9/1932 | Michelson | 2/237 |
| 1,055,094 | 3/1913 | Solitano | 2/227 |
| 1,185,672 | 6/1916 | Huettner | 450/155 |
| 2,417,529 | 3/1947 | Terry | 2/227 |
| 2,418,772 | 4/1947 | Jackson | 2/237 |
| 2,513,039 | 6/1950 | Miller | 2/406 |
| 2,583,992 | 1/1952 | Bouteloup | 2/237 |
| 2,720,653 | 10/1955 | Fowler et al. | 450/155 |
| 3,454,003 | 7/1969 | Sailhen | 450/155 |
| 3,457,926 | 7/1969 | Bacon et al. | 450/155 |
| 4,139,913 | 2/1979 | Garin et al. | 2/237 |
| 4,557,268 | 12/1985 | Maddux et al. | 450/155 |
| 4,697,592 | 10/1987 | Maddux et al. | 450/155 |
| 4,912,860 | 4/1990 | Keller | 2/227 |
| 4,976,653 | 12/1990 | White | 450/155 |
| 5,217,403 | 6/1993 | Nobbs | 450/155 |
| 5,283,910 | 2/1994 | Flint | 2/237 |
| 5,591,122 | 1/1997 | Yewer, Jr. | 2/44 |

*Primary Examiner*—Jeanette E. Chapman
*Attorney, Agent, or Firm*—Mark P. Stone

[57] ABSTRACT

In the case of the panty girdle having a panty part (1) and an abdominal part (2), the panty part (1) and the abdominal part (2) are connected to one another via a tunnel in which a supporting strap (6) is arranged.

5 Claims, 1 Drawing Sheet

PANTY GIRDLE

BACKGROUND OF THE INVENTION

The invention relates to a panty girdle for mothers-to-be, having a panty part, having a longitudinally elastic supporting strap which encircles the body and is intended for the lower abdomen, and having an abdominal part which serves to provide additional support for the upper abdomen and has longitudinal and transverse elasticity which is increased with respect to the elasticity of the supporting belt.

Panty girdles of the abovementioned type in which the merely longitudinally elastic supporting strap is arranged either inside or outside a longitudinally and transversely elastic abdominal part which provide additional support for both the lower abdomen and the upper abdomen of the wearer are known. The known panty girdles are not fully satisfactory in that the supporting straps tend to fold over or turn over, to be precise a strap on the inside tends to do so when the wearer puts on the panty girdle and a strap on the outside tends to do so when the wearer puts on an outer garment. In addition, it has also proved difficult to provide an expedient cut-to-size piece for the abdominal part.

SUMMARY OF THE INVENTION

The object of the invention is to provide a panty girdle of the generic type in question, in the case of which the abovementioned drawbacks are eliminated, i.e. in the case of which the supporting strap is prevented from turning over and the abdominal part is of a shape which is better adapted to the upper abdomen of a pregnant woman than has hitherto been the case. This object is achieved according to the invention in that, in the case of an appropriate panty girdle, at least that section of the supporting strap which comes to rest against the lower abdomen is arranged in a tunnel which is formed from two fabric layers made of elastic material, and in that the abdominal part is connected to the upper border of the tunnel via a seam.

Providing the supporting strap in a tunnel ensures that the supporting strap always maintains its correct position, while the reduction of the abdominal part to the upper-abdomen area permits the abdominal part to be cut in a shape which fits the anatomy well.

BRIEF DESCRIPTION OF THE DRAWINGS

Further details and features of the invention can be gathered from the subclaims, and from the following description of a panty girdle illustrated in the accompanying drawing, in which:

DESCRIPTION OF THE BEST MODES FOR CARRYING OUT THE INVENTION

Figure 1:
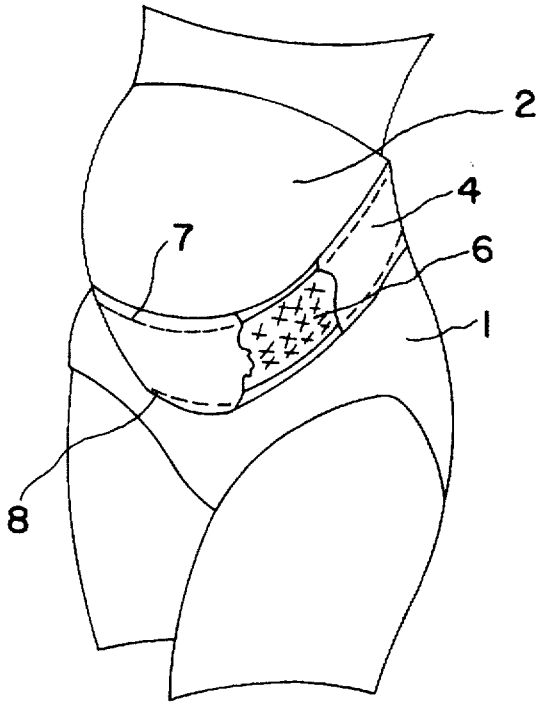
FIG. 1 shows, partly in section, a panty girdle on the body of a pregnant woman.
Figure 3:
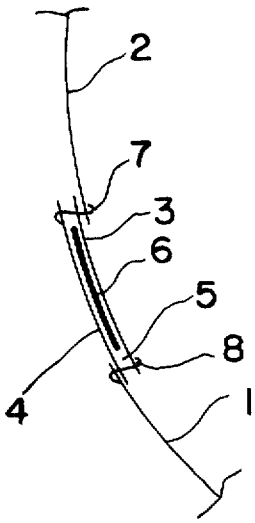
FIG. 3 shows the section along line III—III in FIG. 2.
Figure 2:
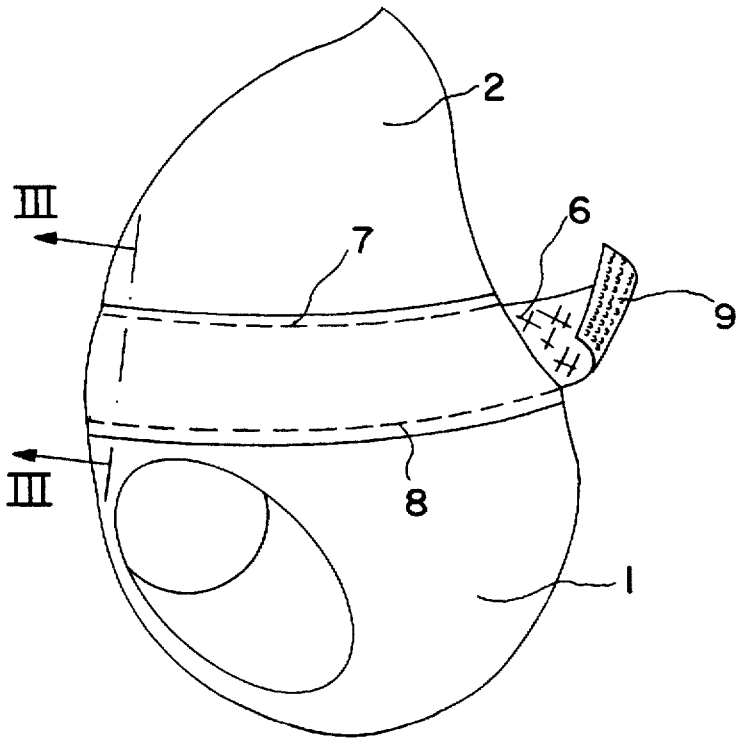
FIG. 2 shows a side view of the panty girdle according to FIG. 1

The panty girdle illustrated in the drawing has a panty part 1 and an abdominal part 2 which is connected to the panty part 1 via a tunnel 5 which consists of two fabric layers 3 and 4 and is intended for receiving a longitudinally elastic supporting strap 6. The actual connection takes place here via seams 7 and 8 which connect the upper and lower borders of the tunnel 5 to the respective parts 1 and 2. While the panty part 1 fully encircles the body of the wearer, the back of the wearer remains exposed both in the region of the tunnel 5 and in the region of the abdominal part 2. The supporting strap 6, which consists of elastic material merely in the longitudinal direction of the strap, is designed as an open strap which can be closed by a touch-and-close fastener 9. The width of the touch-and-close fastener 9 is sufficiently large for the length of the supporting strap 6, which is not connected to the tunnel walls, to be adapted to the changes in the shape of the body as the pregnancy progresses. Since the abdominal part 2 only covers the upper-abdomen area of the wearer, its initial shape can be optimized in terms of cut.

I claim:

1. A panty girdle for mothers-to-be, having a panty part, having a longitudinally elastic supporting strap which encircles the body and is intended for the lower abdomen, and having an abdominal part which serves to provide additional support for the upper abdomen and has longitudinal and transverse elasticity which is increased with respect to the elasticity of the supporting strap, wherein at least that section of the supporting strap (6) which comes to rest against the lower abdomen is arranged in a tunnel (5) which is formed from two fabric layers (3, 4) made of elastic material, wherein a upper border of the tunnel (5) is connected to the abdominal part (2) via a first seam (7), and wherein a lower border of the tunnel (5) is connected to the panty part (1) via a second seam (8).

2. The panty girdle as claimed in claim 1, wherein the supporting strap (6) is provided with means for opening and adjusting the length of said supporting strap.

3. The panty girdle as claimed in claim 1, wherein the supporting strap (6) is exposed in the region of the back of the wearer.

4. The panty girdle as claimed in claim 2, wherein the supporting strap (6) is exposed in the region of the back of the wearer.

5. The panty girdle as claimed in claim 2, wherein said means comprises at least one touch-and-close fastener (9).

* * * * *